US006785062B1

(12) United States Patent
Daley et al.

(10) Patent No.: US 6,785,062 B1
(45) Date of Patent: Aug. 31, 2004

(54) OPHTHALMIC SELF-INSPECTION DEVICE

(76) Inventors: Stuart J. Daley, 683 Valley Vista, Camarillo, CA (US) 93010; Lucinda S. Daley, 683 Valley Vista, Camarillo, CA (US) 93010; Donald J. Daley, 1225-950 Vienna Dr., Sunnyvale, CA (US) 94089

( * ) Notice: Subject to any disclaimer, the term of this patent is extended or adjusted under 35 U.S.C. 154(b) by 0 days.

(21) Appl. No.: 10/735,109

(22) Filed: Dec. 12, 2003

(51) Int. Cl.[7] ..... G02B 27/02
(52) U.S. Cl. ..... 359/802; 359/803
(58) Field of Search ..... 359/802, 803, 359/801, 804, 805, 806, 807, 808, 809, 810; 358/811

(56) References Cited

U.S. PATENT DOCUMENTS

| | | | | |
|---|---|---|---|---|
| 2,394,946 A | | 2/1946 | Stegeman | |
| 2,682,805 A | | 7/1954 | Tomaasovic | |
| 3,374,047 A | * | 3/1968 | Gatchell | 359/727 |
| 3,677,620 A | | 7/1972 | Bettencourt | |
| 5,442,488 A | | 8/1995 | Pastorino | |
| 5,642,234 A | | 6/1997 | Altman et al. | |
| 5,671,096 A | | 9/1997 | Yoshida et al. | |
| 5,937,681 A | | 8/1999 | Myhr et al. | |
| 5,956,985 A | | 9/1999 | Chang | |

* cited by examiner

*Primary Examiner*—Hung Xuan Dang
(74) *Attorney, Agent, or Firm*—Kenneth J. Hovet

(57) ABSTRACT

An eye viewing device with a housing having a center opening containing a magnifying lens and a reflective surface. The housing has outwardly extending hinge flanges. A cover overlies the central opening, and includes an outer abutment surface and an inclined outwardly extending hinge body. The housing hinge flanges and cover hinge body cooperate to provide a hinge joint. The hinge flanges include end portions with hinge contact points which cooperate with a cover contact point to provide a stand for the device when the cover is rotated about the hinge joint until the cover abutment surface and housing underside are in contact.

15 Claims, 3 Drawing Sheets

OPHTHALMIC SELF-INSPECTION DEVICE

BACKGROUND OF THE INVENTION

1. Field of the Invention

The present invention relates to ophthalmic viewing devices. More particularly, the invention concerns an eye view-piece that incorporates a base support structure for hands-free operation.

2. Description of Related Art

Cosmetic mirror assemblies, such as that shown in U.S. Pat. No. 5,442,488, typically include a mirror in a frame, and a magnifying lens to enlarge the image reflected by the mirror. The frame may include a pedestal for supporting the assembly on a vanity counter. A problem with such assemblies is that they are somewhat unwieldy and are not collapsible for stowing in one's pocket or purse.

A magnifying mirror assembly of condensed size is described in U.S. Pat. No. 3,677,620. In this assembly, two lens-mirror receptacles are hinged together. The lens in each receptacle is different, to accommodate the different optical requirements for each eye of a user. This arrangement is not concerned about compact storage of the assembly, or for providing hands-free use.

An illuminated magnifying lens assembly is described in U.S. Pat. No. 5,642,234. The lens assembly has an integrated storage case which includes upper and lower lens cover panels. The panels rotate about a vertical pin extending through a lens frame. For storage, the covers are rotated over a respective top and bottom of the lens frame. For use, the covers are rotated 180° away from the lens frame.

With the present invention, a single cover is used that swings above, around and behind the lens. Additionally, the single cover includes support elements that function as stand means for the overall lens device. This function is not possible with the dual cover panels shown in U.S. Pat. No. 5,642,234.

SUMMARY OF THE INVENTION

The present invention overcomes the prior art deficiencies by providing a palm-sized ophthalmic device that includes a protective cover and hinge assembly. In combination, the assembly provides a stand means for independently supporting the lens in an operable position when placed upon an underlying surface. The device comprises a housing with a center opening that contains a magnifying lens and reflector means. The center opening is enclosed with a cover that is attached to the housing with a hinge assembly. The hinge assembly provides an axis of rotation that is radially and angularly offset from the housing and/or cover, so that the cover can rotate around and behind the housing to a predetermined support position for the housing. The hinge assembly provides one or more contact points that combine with a cover contact point to create the aforementioned stand means.

DESCRIPTION OF THE PREFERRED EMBODIMENTS

Figure 1:
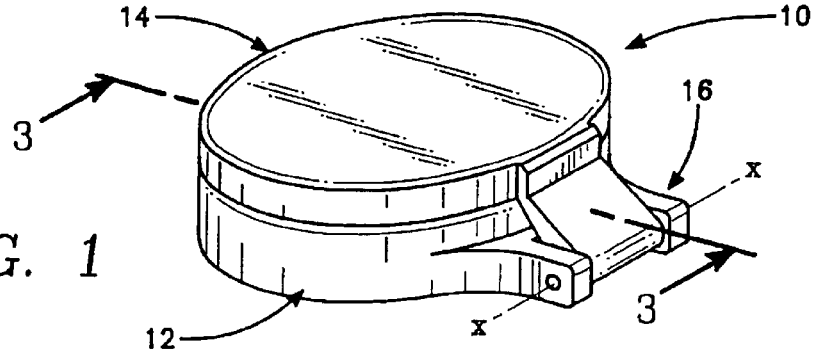
FIG. 1 is an isometric rearward upper view of the ophthalmic device of the present invention in a closed, stowable position.

With reference now to the drawings, FIG. 1 shows the overall device 10 in a closed, stowable position. The device basically comprises a housing or enclosure 12 having an overlying cover 14. A hinge assembly 16, with an axis of rotation x,x, interconnects the cover with the housing. The housing may comprise a circular ring-like structure, but oval or polygonal shapes could also be used. The housing includes a center opening 32 which is defined by inner wall 28.

The center opening 32 is enclosed at its lower end with a bottom member 46. The bottom member has a disc shape, with an outer periphery 50 which has an inset face 48. The bottom member has a bottom upper face 52.

The inner edge of the housing lower end includes a peripheral bottom notch 30. The notch cooperates with inset face 48 to provide a frictional engagement between the housing and bottom member. Other snap-fit types of engagement means could be used, such as inner cooperating ring or rib structures. It is preferred not to have a permanent engagement, so that access to the housing center opening can be made by simple manual dislodgement of the bottom member. The bottom member has a bottom underside 54, which may be a flat, planar surface coextensive with the lower end of the housing wall 20, or it may include a shallow recess as shown.

Resting upon the bottom member upper face 52, is mirror 56. The mirror has a peripheral shape that corresponds to the shape of the housing center opening, so that it fits snugly therein without unwanted play. The mirror construction is known in the art, and is typically flat with a suitable thickness of clear glass or plastic, having an underlying reflective coating.

Positioned about the peripheral portion of mirror 56, is an annular spacer shown as gasket 60. The gasket is preferably resilient to provide a cushioned support for the overlying lens 64.

The outer periphery of the lens 64 rests upon gasket 60 wherein, depending upon the optics desired, the lens may have a convex top side 68, and a convex underside 66 as shown. As such, the gasket 60 should have sufficient thickness to maintain convex underside 66 out of contact with mirror 56. It will be appreciated that if the lens underside is flat, the need for a gasket may be eliminated. It is preferred that the height of the housing wall 20 will be sufficient so that the lens top side 68 will not extend above the housing top opening 32.

Figure 2:
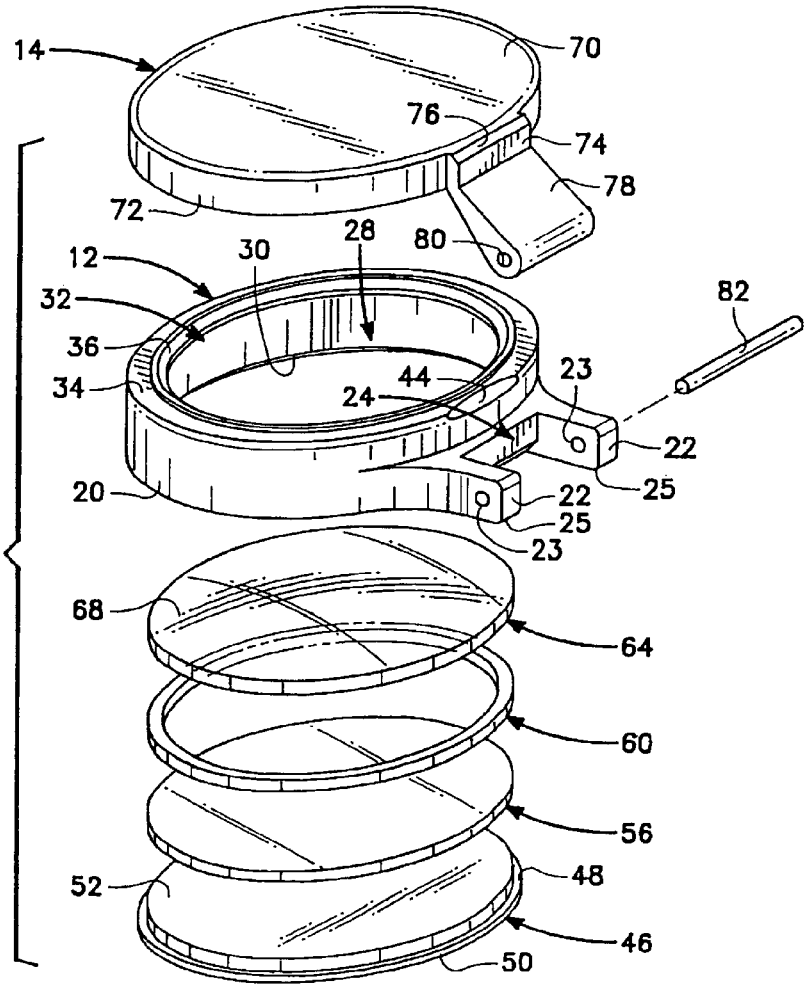
FIG. 2 is an isometric exploded view of the device shown in FIG. 1.
Figure 3:
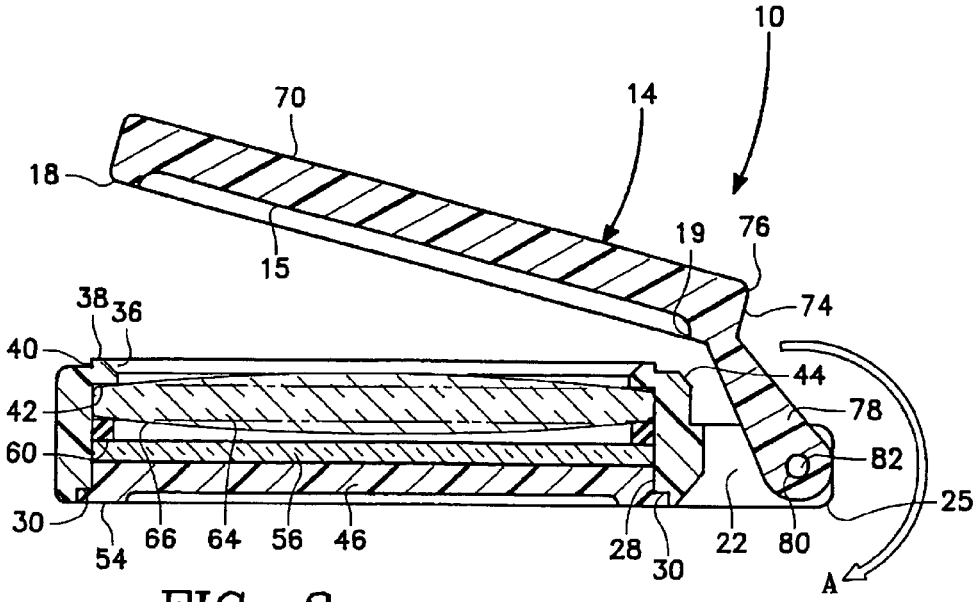
FIG. 3 is a cross-sectional view taken along lines 3—3 of FIG. 1, with the cover rotated above the housing.

As best shown in FIGS. 2 and 3, the housing top opening 32 includes an outer rim surface 34, which merges into an inner flange 36. The inner flange has an upraised flange portion 38, creating an outer directed flange face 40. The inner flange 36 extends inwardly a predetermined distance greater than the interior diameter of the housing center opening. In this way, a flange underside 42 is created that functions as an annular abutment for constraining the lens 64 within the center opening 32.

With reference to FIG. 2, extending outwardly from housing wall 20 are two spaced-apart hinge flanges 21. The flanges are separated by a predetermined space 24. The hinge flanges preferably extend from the lower one-half portion of the housing wall height, and include outer end-portions 22. The hinge flanges are preferably mirror images of each other, and include transverse pin openings 23 that extend across the end portions. Respective lower corners of each hinge flange end-portion constitute housing contact points 25 in a manner to be hereinafter described.

Cover 14 overlies the housing central opening 32 and, preferably, has a diameter and shape about equal to the peripheral shape of the housing. In this way, the cover wall 72 will be about vertically coextensive, and in conformance with housing wall 20. The cover includes a top surface 70 and a cover underside 15.

As shown, the cover underside is recessed to provide a recessed wall 19 that is cooperative with outer face 40 of the housing inner flange 36. It is expected that a frictional engagement will thereby occur between the recess wall and outer face. In a manner similar to the bottom member engagement, it is desired to provide a firm but releasable engagement means for the cover to the housing. The annular flat surface that extends radially outward from the cover recessed underside 15, is underside rim 18. When the cover is closed, the underside rim will be adjacent to housing outer rim surface 34.

Extending outwardly from a predetermined angular segment of cover wall 72, is an extension part 74. The extension part creates an added projection, i.e., thickness, to the cover wall 72. Across the upper end of the extension part is a beveled upper abutment corner 76.

The extension part extends downwardly from the abutment corner, and merges into an downwardly and outwardly inclined hinge body 78. Preferably, the hinge body is constructed of a solid material, and includes a distal end portion through which extends a transverse hinge aperture 80.

The width of the hinge body should be slightly less than space 24 between housing hinge flanges 22. When the cover is in place upon the housing rim surface 34, aperture 80 will be in coaxial alignment with pin openings 23 of the hinge flanges. In this position, hinge pin 82 may be inserted through the pin openings and hinge aperture along axis x, x, to create an overall hinge assembly 16.

To accommodate the downwardly extending extension part and underside of hinge body 78 when the cover is closed, a flat section 44 may be required along a corresponding segment of rim surface 34. The flat section thereby allows complete closure of the cover over the central opening of the housing.

Although not shown, it will be appreciated that the hinge flanges and hinge body may be connected to opposite members, whereby the hinge flanges may extend from the cover wall 72 and the extension part and hinge body may extend outwardly and upwardly from the housing wall 20. Regardless of the placement of the hinge assembly component parts, a notable feature of the invention is the ability of the cover to swing away from the top opening, as shown by arrow A in FIG. 3. Preferably, the arc of rotation will be at least about 270°, to a position where abutment corner 76 of extension part 74 will engage underside 54 of bottom member 46. The position and angular orientation of the cooperating engagement members are intended to provide an effective hands-free viewing angle for a user between the cover 14 and housing 12.

Figure 4:
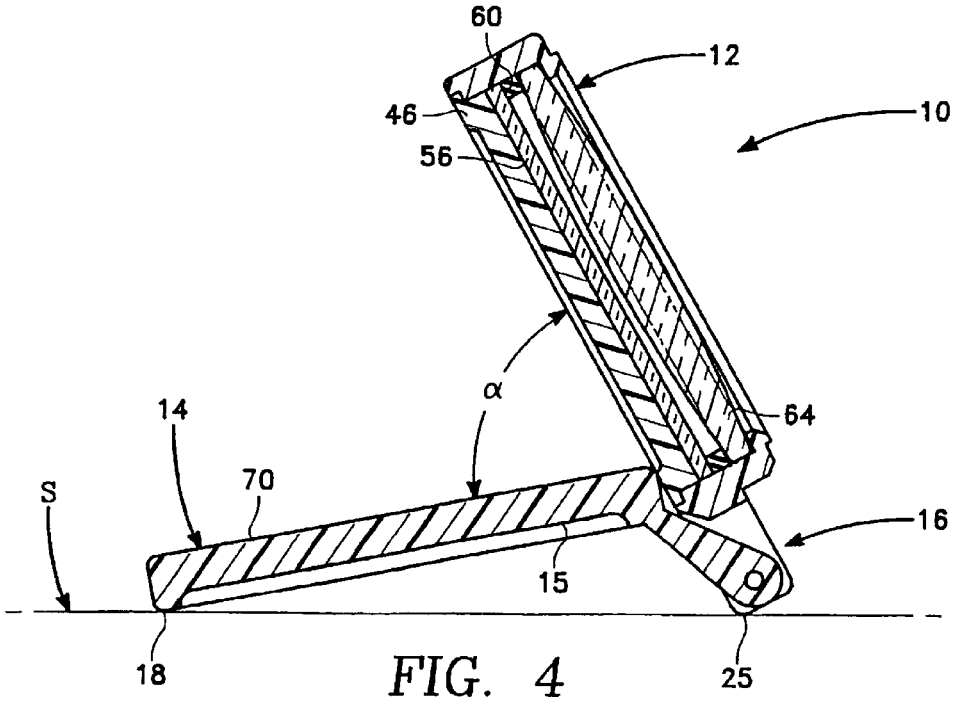
FIG. 4 is a cross-sectional view similar to FIG. 3, with the device of FIG. 1 in an operable position resting on a surface.

The preferred angular alignment between the housing and cover for optimum user viewing, ranges from 60° to 100°, as shown by angle $\alpha$ in FIG. 4. This preferred orientation is achieved by determining the radial distance that hinge body 78 should extend from cover wall 72, and the angle of inclination between the plane of cover 14. This assumes that hinge flanges 22 will extend radially outwardly from housing wall 20, in a plane that is coextensive with the plane of the housing.

Upon achieving the desired radial and angular alignments of the hinge assembly and cover parts for effective use of the ophthalmic device, a stand means is created. In its basic form, the stand means comprises housing contact points 25 and at each outer hinge flange corner and cover underside contact point 18. This arrangement creates a three-point tripod stand means, so that when the device is placed upon a surface S, the aforementioned lens mirror orientation will be in an operable position. It can be seen that angular adjustment of the lens-mirror in housing 12 relative to surface S, can also be achieved by lengthening or shortening the radial extent of the hinge flanges, or by any of the aforementioned adjustments in relation to angle $\alpha$.

Figure 5:
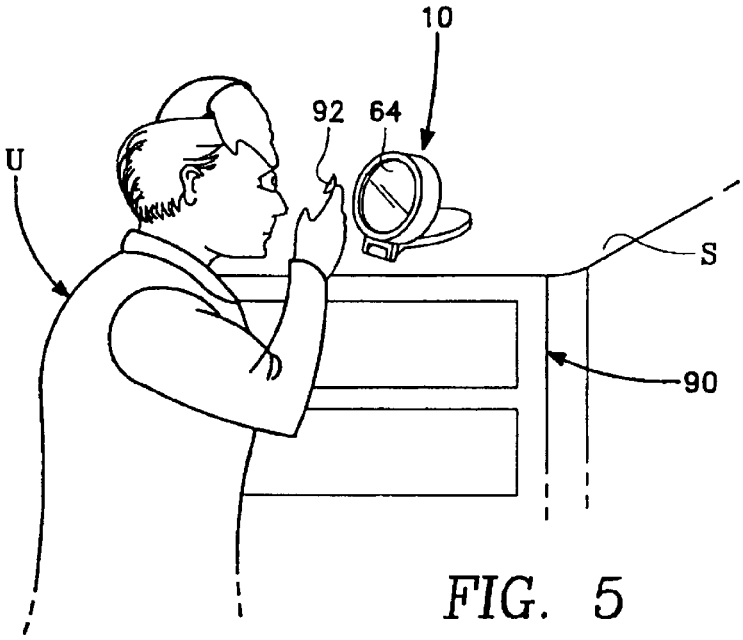
FIG. 5 is an illustration of a hands-free use of the device shown in FIG. 1.

Use of the above-described device in its operable position is depicted in FIG. 5. It is particularly notable that by providing the underlying stand contact points through the cooperating structures of the hinge assembly and cover, a user (U) will no longer need to occupy one hand to hold the device during use. Instead, as illustrated in FIG. 5, the device 10 can rest upon the top surface S of a dresser 90 and both hands of the user can insert or remove a contact lens, shown by reference 92. When use is completed, one simply needs to counter-rotate the cover about the hinge axis x, x until the cover is in a closed position, as depicted in FIG. 1. The device may then be stowed in one's pocket, purse or the glove compartment of a vehicle. It can be seen that the device will also have other uses in relation to cosmetics and the removal of eye irritants.

Figure 6:
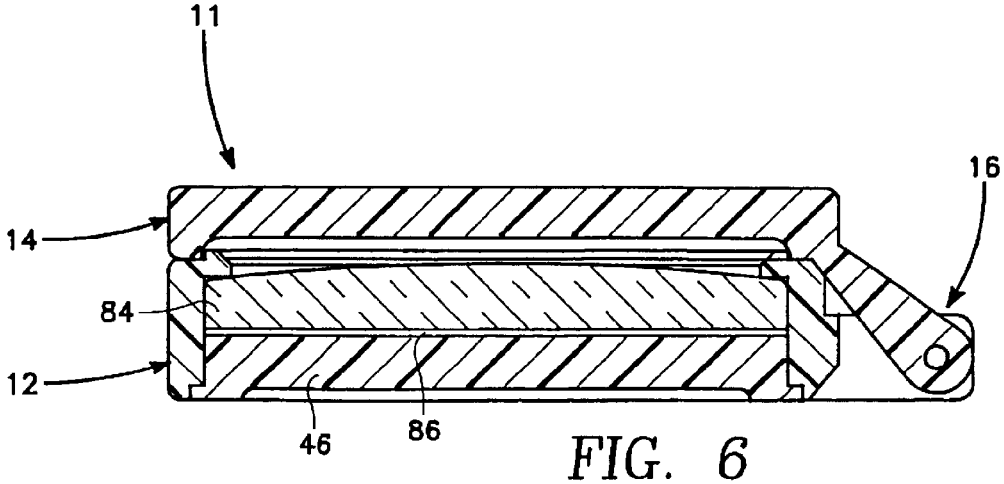
FIG. 6 is a cross-sectional view of an alternative lens-reflector member.

FIG. 6 shows an alternative device 11 wherein the housing, hinge assembly and cover are identical to that described with respect to the FIG. 1 embodiment. In this alternative, lens 84 has a flat underside which is covered with a reflective coating 86. This construction optionally eliminates the need for gasket 60, and also eliminates the need for a separate mirror structure. Otherwise, all other aspects and advantages of the invention are the same as that described with reference to device 10.

While the foregoing descriptions set forth illustrative embodiments in specific detail, it will be apparent that variations, alterations and/or modifications could be made without departing from the spirit and scope of the invention. It is, therefore, desired that all such variations, alternatives and modifications come within the purview of the appended claims, and that the claims should not be limited by the aforesaid specific embodiments.

I claim:

1. An ophthalmic device comprising:

a housing having a wall structure that circumscribes a center opening, said center opening containing an image reflective and magnification means;

a cover overlying said center opening, said cover having an abutment surface;

a hinge assembly interconnecting said cover and said housing; and, said hinge assembly providing an axis of rotation between said housing and said cover that is radially and angularly offset from said wall structure; and, said cover being rotatable from a closed position overlying said center opening to an open position behind said housing until said cover contacts the abutment surface at a predetermined angular orientation.

2. The device of claim 1 wherein said cover has an underside rim; and, said hinge assembly includes at least one contact point which co-acts with said rim for supporting said device upon a selected underlying surface when the cover is in said open position.

3. The device of claim 2 wherein said cover has a peripheral wall, and said hinge assembly comprises a hinge body that inclines downwardly and outwardly from said peripheral wall;

at least two hinge flanges extending outwardly from said housing wall structure, with at least one of said hinge flanges including said contact point; and, said hinge assembly further including a hinge pin extending transversely through said hinge flanges and hinge body along said axis of rotation.

4. The device of claim 3 wherein said peripheral wall includes an extension part, and said hinge body extends from said extension part.

5. The device of claim 4 wherein the extension part includes said abutment surface.

6. The device of claim 3 wherein at least said two hinge flanges are spaced-apart a predetermined distance, and said hinge body having a width that is less than said predetermined distance.

7. The device of claim 3 wherein said cover defines a cover plane and said hinge body inclines at an acute angle relative to said cover plane.

8. The device of claim 3 wherein said housing defines a housing plane, and said hinge flanges extend from said wall structure in a plane that is about parallel to said housing plane.

9. The device of claim 8 wherein each of said at least two hinge flanges extend to an outer end portion with a contact point being located at each one of said outer end portions.

10. The device of claim 9 wherein said hinge body has a distal end portion, said hinge pin extending through said distal end portion and through each one of said hinge flange outer end portions.

11. In a device for viewing magnified images of a user's eye, comprising:

an enclosure having an enclosure underside and an image-reflecting and magnifying means;

a cover for said enclosure, having an abutment surface and a cover underside, wherein the improvement comprises:

a. a hinge assembly that interconnects said cover and said enclosure, said hinge assembly providing an angular rotation of said cover about an axis of rotation by a predetermined amount until said abutment surface of engages said enclosure underside, said hinge assembly including at least one hinge contact point, and said cover underside providing at least one cover contact point to create a support stand for resting the enclosure in an operational position upon an underlying surface.

12. The device of claim 11 wherein said cover defines a cover plane, and said enclosure defines an enclosure plane, said axis of rotation being offset from either one or both of said cover plane and enclosure plane.

13. The device of claim 12 wherein said axis of rotation is spaced-apart from said enclosure and said cover.

14. The device of claim 13 wherein said cover plane and said enclosure plane form an angle that ranges from about 60° to 100° when the enclosure is in an operational position.

15. A method of using an ophthalmic device comprising an enclosure containing image reflecting and magnifying means, and a cover having a cover contact point, said cover overlying the enclosure and being connected to the enclosure by a hinge assembly, said hinge assembly having an axis of rotation and a hinge contact point; the method comprising:

a. while holding the enclosure and cover in a generally horizontal position, grasping the cover and rotating the cover about said axis of rotation by an angular amount of at least about 270°, until a portion of the cover abuts a portion of the enclosure;

b. rotating the device about 60° to 100° while maintaining the cover in the abutted position of step a.;

c. placing the device on a selected underlying surface, so that the cover contact point and hinge contact point rest upon the underlying surface; and, d. while the device rests upon said selected underlying surface, looking into said enclosure and viewing a reflected image.

* * * * *